US007251439B2

(12) United States Patent
Robles Flores et al.

(10) Patent No.: US 7,251,439 B2
(45) Date of Patent: Jul. 31, 2007

(54) SHIELD FOR CHARGING DEVICE IN XEROGRAPHIC PRINTING DEVICE HAVING REDUCED RATE OF CONTAMINATION

(75) Inventors: Eliud Robles Flores, Webster, NY (US); John Robert Uchal, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/191,981

(22) Filed: Jul. 29, 2005

(65) Prior Publication Data

US 2007/0025771 A1 Feb. 1, 2007

(51) Int. Cl.
*G03G 15/02* (2006.01)

(52) U.S. Cl. ..... 399/172; 399/170

(58) Field of Classification Search ..... 399/170–175, 399/115, 168, 311; 250/324–326
See application file for complete search history.

(56) References Cited

U.S. PATENT DOCUMENTS

| | | | | |
|---|---|---|---|---|
| 3,564,239 | A * | 2/1971 | Kushima | 250/325 |
| 5,291,247 | A * | 3/1994 | DeCecca | 399/115 |
| 5,742,874 | A * | 4/1998 | Koshimura et al. | 399/173 |
| 6,070,026 | A * | 5/2000 | Claflin et al. | |
| 6,411,788 | B1 * | 6/2002 | Ogasawara | |

* cited by examiner

*Primary Examiner*—David M. Gray
*Assistant Examiner*—Laura K Roth
(74) *Attorney, Agent, or Firm*—Oliff & Berridge PLC

(57) ABSTRACT

A xerographic printing device, including a charging device having a shield. In some embodiments of the shield of the charging device in the xerographic printing device, a plurality of holes are provided in an evenly spaced linear fashion extending nearly a full length of the charging device shield on a downstream process side of the charging device shield. The charge device can be a corotron, a dicorotron, a scorotron, a discorotron, a pin corotron, a pin scorotron, or any other known or later developed charging device of that type.

15 Claims, 9 Drawing Sheets

SHIELD FOR CHARGING DEVICE IN XEROGRAPHIC PRINTING DEVICE HAVING REDUCED RATE OF CONTAMINATION

BACKGROUND

This application relates generally to xerographic printing devices including charging devices such as corotrons, scorotrons, AC dicorotrons, AC discorotrons, and the like.

Xerographic printing machines often include charging devices such a corotron, dicorotron, scorotron or discorotron. A corotron is a wire device. A dicorotron is a corotron where the wire has a glass coating. A scorotron is a corotron with a grid on top of it. Similarly, a discorotron is a dicorotron with a grid on top of it. Other charging devices used in xerographic printing machines include pin corotrons and pin scorotrons. The pin variations of these devices substitute a series of pins for a smooth wire or substitute an etched wire having tips resembling a series of pins in a saw tooth shape. Some of these pin based charging devices include an array of pins comprising two or more lines of pins.

Some xerographic printing machines include a photoreceptor. Some photoreceptors are shaped with a surface resembling a belt. When charging the photoreceptor in a xerographic printing machine, it is desirable for the charge to be uniform around the surface of the belt. Variations in the magnitude of the charge around the surface of the photoreceptor are referred to as charge non-uniformities. Charge non-uniformities result in variations in image intensity in a resulting print where the original image does not vary in intensity. Non-uniformities that occur across the width of the photoreceptor are referred to as cross-web non-uniformities. Non-uniformities that occur along the length of the photoreceptor are referred to as down-web non-uniformities. Similar concepts apply to the current uniformity of the charging device.

When operating a scorotron or discorotron charging device, for example, a bias voltage is typically applied. This bias voltage typically corresponds to a charge to which it is desired to charge the photoreceptor. Bias voltages typically range from 300 volts to 1,000 volts. A typical average bias voltage is in the range of 400 to 500 volts.

Some xerographic engines have problems arising from voltage and/or current non-uniformities. Variances in electrical conductivity can be a function of device operation history such as, e.g., powered versus unpowered. This conductivity variation can also cause an operating voltage variation.

Other causes of current and voltage non-uniformities relate to harmful corona effluents in the apparatus and to the method of removing the harmful corona effluents from the machine cavity. The harmful corona effluents are caused by the ionization of the air in the vicinity of a charge that typically exceeds 4,000 volts. This ionization of the air in the vicinity of a high electrical charge generates several gases including ozone. These gases are typically filtered and reconditioned but they can be highly dangerous and even toxic at certain levels of concentration. Therefore, a vacuum is typically employed in the cavity of the machine to remove these unwanted gases including ozone.

Typically, charging devices contain a shield that includes some sort of orifice in order for the vacuum to properly remove the unwanted gases from the machine cavity. However, the quantity, shape and orientation of the orifices in the shield, and the associated air flow generated by the vacuum removal of unwanted gases affect the charge uniformity and the current uniformity of the photoreceptor. Thus, the vacuum removal of unwanted gases from the machine cavity is another among the causes of charge non-uniformity in the photoreceptor.

There are many byproducts of the ionization process described above. In addition to ozone, NOx is another undesirable byproduct. For example, when NOx attaches to $H_2O$, nitric acid is created. Nitric acid is also very harmful and can also be toxic.

In the operation of a xerographic printing device, it is not uncommon for toner to pass through the airflow pattern in and around the zone of the charging device (the volume or area around the wire, the shield and the grid of the charging device). In the process, it is not uncommon for toner suspended in the airflow pattern around the zone of the charging device to be deposited onto the grid.

In the typical fluid mechanics of airflow, a boundary layer forms between the airflow and a stationary surface past which the air is flowing. These boundary layers have a lower airflow rate than the airflow outside of the boundary layer due to the friction created between the flow of air in the boundary layer and the stationary surface past which that air is flowing.

It is not uncommon in the operation of a typical xerographic printing device for the boundary layers that form in the airflow in the zone of the charging device to be clouded with toner debris. This toner debris in the boundary layers of the airflow travels in very close proximity to the photoreceptor. If this cloud of toner debris is not very tightly controlled, the toner escapes from the developing area of the boundary layer.

When the boundary layer interacts with the corona flow and the vacuum flow described above, the interacting airflow effects of the corona flow and the vacuum flow with the boundary layer often disturb the toner particles suspended in the boundary layer. Often, this perturbation of the toner particles suspended in the boundary layer results in the discharge of the toner outside the boundary layer. This discharge of the toner outside the boundary layer often causes the toner to be deposited on the grid in the charging device.

Further, if the cloud of toner suspended in the boundary layer is too weak, it is typical for the flow of the boundary layer itself to disturb the toner in the boundary layer such that pieces of toner are spun or dropped out of the boundary layer. The spinning or dropping of toner particles out of the boundary layer also often results in the deposition of toner particles on the charging device grid in the form of localized dirt build up.

These discontinuities in localized dirt buildup on the grid in turn induce streaks or other unwanted marks in subsequent prints from the xerographic printing device having a charging device with the grid containing the localized dirt buildups. Thus, the faster the localized dirt builds up on the grid, the more rapidly the corresponding print quality from the xerographic printing device having that grid deteriorates, and thus the more frequently the grid needs to be cleaned.

With respect to the architecture of the xerographic printing machine, one convention refers to points furthest inside the machine, that is, points furthest away from a user standing in front of the machine, as inboard portions of the machine. Similarly, according to this convention, portions of the machine closest to the front of the machine, that is, points nearest where a user stands, are referred to as outboard portions of the machine. In one architecture for a xerographic printing machine, the Cross-web orientation of the photoreceptor corresponds to the inboard to outboard or outboard to inboard direction. Similarly, according to this nomenclature, the down-web direction is also referred to as the process direction. This nomenclature is used herein to define a lateral direction and a longitudinal direction.

SUMMARY

In various exemplary embodiments, a current or wind created in the ionized air at the tips of the pins of the charging device is more concentrated. As described in more detail hereinafter, the various exemplary embodiments achieve an enhanced voltage uniformity and an enhanced current uniformity in photoreceptor charging devices used in xerographic printing machines.

In various exemplary embodiments, other corona effluents are reduced.

In various exemplary embodiments, corona effluents are more efficiently removed from the machine cavity.

In various exemplary embodiments, the efficient removal of harmful corona effluents from the machine cavity results in improved charge uniformity and improved current uniformity.

In various exemplary embodiments, the more efficient removal of harmful corona effluents from the machine cavity results in improved print quality.

In various exemplary embodiments, more than one charging device is used. Thus, in various exemplary embodiments a scorotron is used as a primary charging device and a discorotron is used as a secondary recharging device. In various exemplary embodiments, the pin scorotron charges the photoreceptor to a voltage higher than the desired voltage and then a discorotron is used to gradually dissipate some of the overcharged voltage resulting in a more uniform charge.

In various exemplary embodiments, a discorotron charging device is used.

In various exemplary embodiments, a specific design of a shield in the charging device is employed to achieve one or more of the foregoing benefits.

In various exemplary embodiments, a shield for a charging device is employed having a plurality of orifices.

In various exemplary embodiments, a shield for a charging device is employed having a plurality of vacuum holes.

In various exemplary embodiments, a shield for a charging device is employed having a plurality of vacuum holes oriented in a linear manner.

In various exemplary embodiments, a shield for a charging device is employed having a plurality of vacuum holes oriented in a downstream location.

In various exemplary embodiments, a shield for a charging device is employed having a plurality of vacuum holes that extend nearly the full length of the charging device shield.

In various exemplary embodiments, a shield for a charging device is employed having a plurality of vacuum holes that are evenly spaced apart from each other.

Thus, an exemplary printing machine comprises a charging device that forms a variable charging device operating voltage. In one exemplary embodiment of a printing machine, a scorotron charging device operates on a constant current of 2.085 mA. The power supply output voltage varies to maintain this constant current. A voltage monitor signal is available to the machine control system along with the grid voltage.

In various exemplary embodiments, a High Frequency Service Interval cleaning interval remains on the faulted charging device. This information can be used to instruct an operator to clean or replace the charging device. In various exemplary embodiments, this determination depends on the run time since the last cleaning. A charging device that trips a fault shortly after a previous cleaning would be replaced. A fault that occurs close to the cleaning interval would instruct the operator to clean the device.

These and other problems overcome by, and other features and advantages of this invention, are described in, or are apparent from, the following detailed description of various exemplary embodiments according to this invention.

BRIEF DESCRIPTION OF THE DRAWINGS

Various exemplary embodiments of this invention will be described in detail, with reference to the following figures, wherein.

DETAILED DESCRIPTION OF EMBODIMENTS

Figure 1:
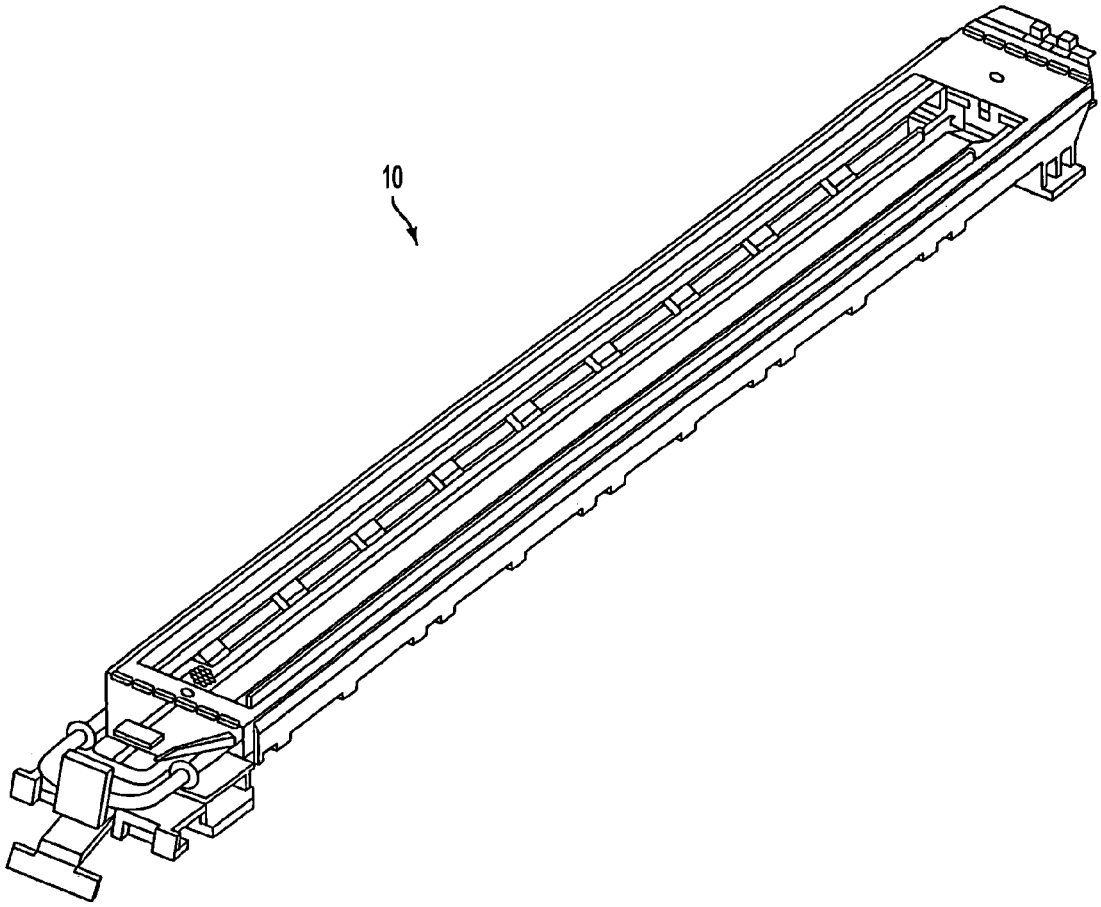
FIG. 1 is a perspective schematic of one exemplary embodiment of a pin scorotron with the hex pattern of the grid removed.

FIG. 1 is a perspective schematic of one exemplary embodiment of a scorotron 10 with the grid removed. Corotrons, scorotrons, AC dicorotrons, AC discorotrons, and the like, are well known in the field of xerographic charging devices. In various exemplary embodiments, any currently known or later developed style of scorotron 10, or corotrons, AC dicorotrons, AC discorotrons, or the like, currently known or later developed, may be used.

Figure 2:
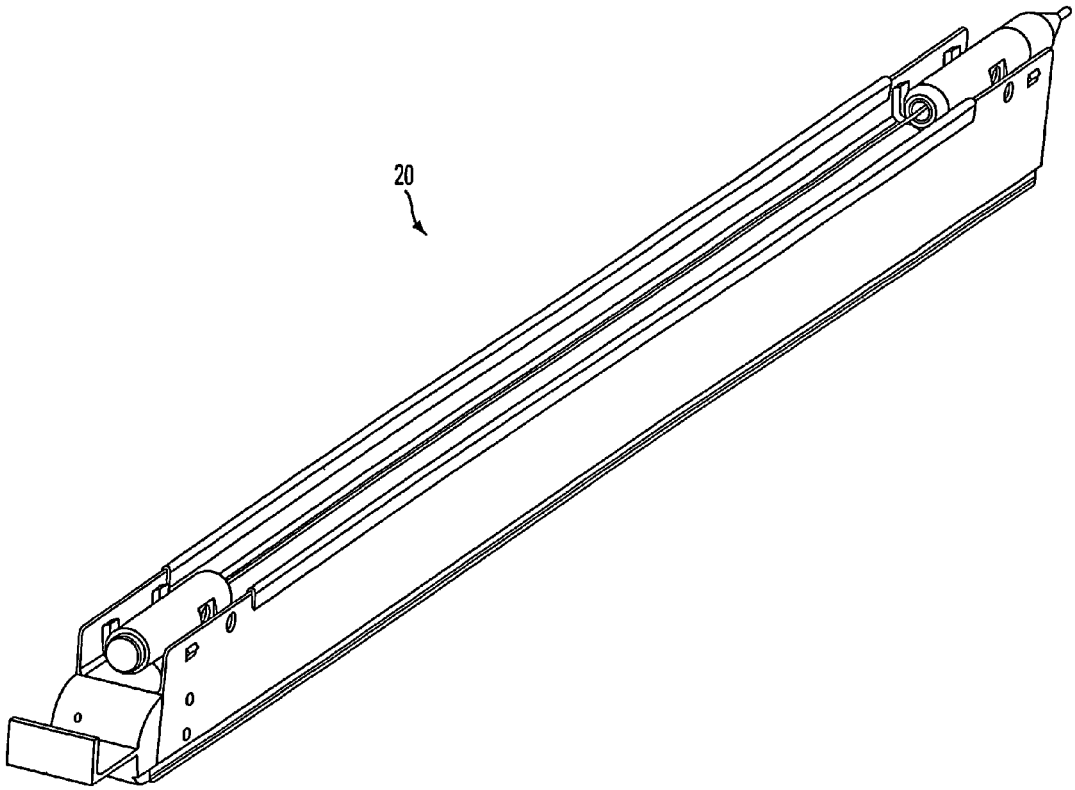
FIG. 2 is a perspective schematic of one exemplary embodiment of an AC dicorotron with the grid removed.

FIG. 2 is a perspective schematic of one exemplary embodiment of an AC dicorotron 20 with the grid removed. AC dicorotrons are well known in the field of xerographic charging devices. In various exemplary embodiments, any type of AC dicorotron 20, or scorotron, corotrons, AC discorotrons, or the like, currently known or later developed, may be used.

Figure 3:
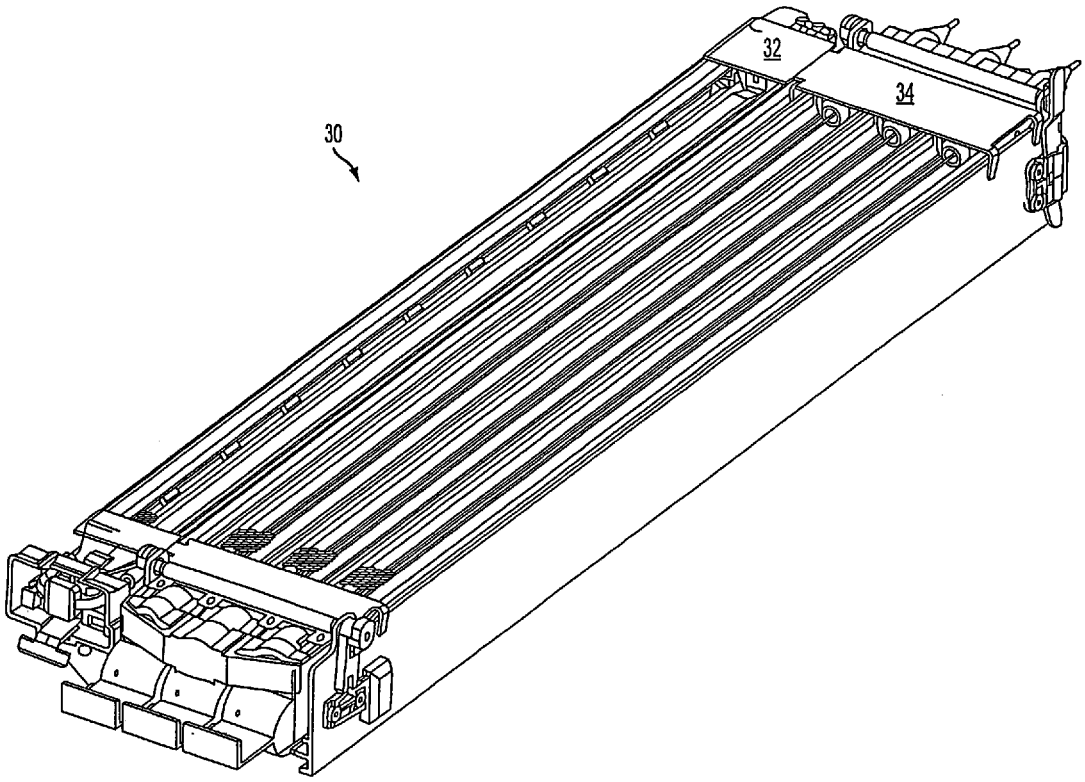
FIG. 3 is a perspective schematic of one exemplary embodiment of a charge-recharge station including one pin scorotron and three AC dicorotrons with the hex pattern of their grids removed.

FIG. 3 is a perspective schematic of one exemplary embodiment of a charge-recharge station 30. The exemplary charge-recharge station 30 includes one pin scorotron in housing 32 and three AC dicorotrons in housing 34. Most of the portions of the grids are removed from the top of the pin scorotron in housing 32 and from the top of the three AC dicorotrons in housing 34. In various exemplary embodiments, any currently known or later developed style of charge-recharge station 30 may be used. Thus, in various exemplary embodiments, a charge-recharge station 30 is employed including a number of pin scorotrons other than one. Similarly, in various exemplary embodiments, a charge-recharge station 30 is employed using a number of AC dicorotrons other than three. Likewise, in various exemplary embodiments, a charge-recharge station 30 is employed using one or more type of xerographic charging device other than a pin scorotron or an AC discorotron, including, but not limited to, discorotrons. In various exemplary embodiments, a charge-recharge station 30 is employed using any combination of known or later developed type of xerographic charging device.

Figure 4:
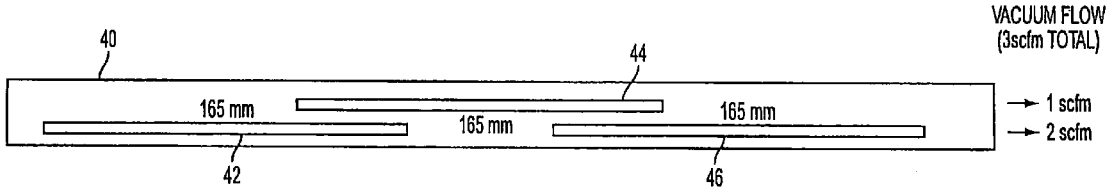
FIG. 4 is a top plan view of an exemplary embodiment of a charging device shield.

FIG. 4 is a top plan view of an exemplary embodiment of a charging device shield 40. The exemplary charging device shield 40 includes vacuum slots 42, 44, 46. Vacuum slots 42 and 46 share a common axis in a lateral direction. The lateral direction corresponds to the direction in which the print process flows, or down-web direction. In the depicted embodiment, vacuum slot 44 is in the upstream process direction and the axis shared by vacuum slot 42 and 46 is in a downstream process direction with respect to vacuum slot 44. Vacuum slot 44 has an axis in a lateral direction different than the common axis shared by vacuum slot 42 and vacuum slot 46.

The total vacuum flow through vacuum slots 42, 44, 46 is three standard cubic feet per minute (scfm). The 3 scfm total vacuum flow through vacuum slots 42, 44, 46 is distributed as follows. Vacuum slot 44 has a total flow of 1 scfm. Vacuum slots 42, 46 share a combined vacuum flow of 2 scfm. In various exemplary embodiments, the vacuum flow through slots 42, 44, 46 is distributed according to a different ratio. Thus, in various exemplary embodiments, the total vacuum flow is a value other than 3 scfm.

In this exemplary embodiment, vacuum slot 42 is 165 mm long. Similarly, in this exemplary embodiment, vacuum slot 44 is 165 mm long. Likewise, in this exemplary embodiment, vacuum slot 46 is 165 mm long. Thus, in this exemplary embodiment, vacuum slot 42, vacuum slot 44 and vacuum slot 46 all have the same length. In various other exemplary embodiments, one or more of vacuum slot 42, vacuum slot 44 and vacuum slot 46 have a length that is different than the other vacuum slots. Thus, in various exemplary embodiments, vacuum slot 42, vacuum slot 44, and vacuum slot 46 have other lengths.

In FIG. 4, one end of vacuum slot 44 overlaps an end of vacuum slot 42 in a longitudinal direction. The longitudinal direction corresponds to the inboard/outboard or cross-web direction. An opposing end of vacuum slot 44 overlaps an end of vacuum slot 46 in the longitudinal direction. This overlapping structure in the longitudinal direction typifies the exemplary embodiment of charging device shield 40.

Vacuum slot 44 overlaps vacuum slot 42 for about one-third of the length of vacuum slot 44. Similarly, vacuum slot 44 overlaps vacuum slot 46 for about one-third of the length of vacuum slot 44. Thus, the length of the overlap between vacuum slot 42, vacuum slot 44 and vacuum slot 46 is approximately 25 mm to 55 mm for each overlapping portion.

As a consequence of the overlapping structure of exemplary charging device shield 40, the air flow is greater in the vicinity where the vacuum slots 42, 44, 46 overlap than the air flow in an area where vacuum slot 42 is present but not overlapping with vacuum slot 44, an area where vacuum slot 44 is present but not overlapping with either vacuum slot 42 or vacuum slot 46, and an area where vacuum slot 46 is present but not overlapping with vacuum slot 44. Because of this differential in air flow at different points on the exemplary charging device shield 40, the effects on the voltage uniformity and current uniformity of the charging device are variable depending on the location on the device. This variance in the charge uniformity and the current uniformity have a negative effect on the operation of the device and thus on subsequent print quality.

For example, the overlapping structure of exemplary charging device shield 40 is believed to induce voltage spikes. These voltage spikes are manifested as cross-web non-uniformities. The cross-web non-uniformities take away smoothness of the charging process. One way that this occurs is by the addition of higher frequency noise to the cross-web voltage profile. These interactions and competing effects can lead to an instability in the air flow. The instability in the air flow can include urging an air flow in the opposite direction as the vacuum removal of the corona effluents. Thus, the instability in air flow can inhibit the efficient removal of the corona effluents. This will be discussed in greater detail below.

The performance of exemplary charging device shield 40 was compared to the performance of other exemplary charging device shields in tests. The results of these tests are described below.

Figure 5:
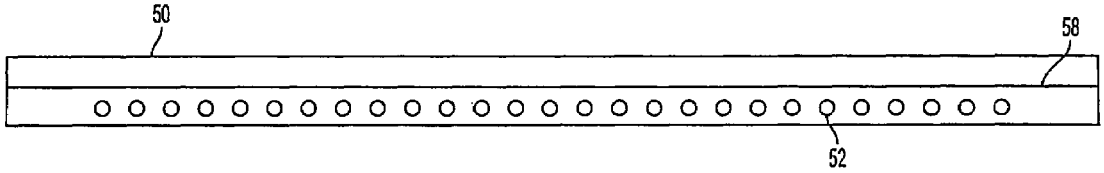
FIG. 5 is a top plan view of a second exemplary embodiment of a charging device shield.

FIG. 5 is a top plan view of a second exemplary embodiment of a charging device shield 50. The exemplary charging device shield 50 includes a plurality of vacuum holes 52. In the exemplary charging device shield 50, the plurality of vacuum holes 52 are arranged in an approximately linear fashion. In various exemplary embodiments, the plurality of vacuum holes 52 are arranged in an exactly linear fashion. In various exemplary embodiments, the plurality of vacuum holes 52 are arranged in a fashion that is not linear and not approximately linear.

In the depicted embodiment of a charging device shield 50, the linear extent of the vacuum holes 52 is nearly the same as the length of the exemplary charging device shield 50 itself. In various exemplary embodiments, the arrangement of the vacuum holes 52 corresponds to a greater or lesser extent of the length of the exemplary charging device shield 50.

In the exemplary embodiment of a charging device shield 50 depicted in FIG. 5, the spacing between each of the plurality of vacuum holes 52 is the same. In other words, the plurality of vacuum holes 52 are evenly spaced across nearly all of the linear extent of exemplary charging device shield 50. In other exemplary embodiments, any other uniform pattern from the inboard to the outboard direction (or vice versa) may be used. In various exemplary embodiments, the space between each of the plurality of vacuum holes is not the same. Thus, in other exemplary embodiments, the plurality of vacuum holes 52 are not evenly spaced.

In exemplary charging device shield 50, the total vacuum flow is 3 scfm as with exemplary charging device shield 40. In various exemplary embodiments, the total vacuum flow of exemplary charging device shield 50 is a value other than 3 scfm.

In the depicted embodiment of exemplary charging device shield 50, the total vacuum flow is distributed as follows. The plurality of vacuum holes 52 have a total flow of 3 scfm distributed between them. In various other exemplary embodiments, the total vacuum flow for the exemplary charging device shield 50 is distributed between the plurality of vacuum holes 52 in a different manner.

In various exemplary embodiments, a charging device wire 58 is above the exemplary charging device shield 50. In various exemplary embodiments, the charging device wire 58 is replaced with a series of charging pins. In various other exemplary embodiments, the charging device wire 58 is a smooth wire. In various exemplary embodiments, the charging device wire 58 has a jagged, saw-tooth structure. This structure simulates the effect of a series of pins. In various exemplary embodiments, the charging device wire 58 is coated. In various exemplary embodiments, the charging device wire 58 is not coated.

Although not shown in FIG. 4, in various exemplary embodiments of the charging device shield 40, the wire 58 is included as with the embodiments of charging device shield 50 described above.

In various exemplary embodiments, the charging device wire 58 is oriented along a full length in the center of the width of the exemplary charging device shield 50. In various other exemplary embodiments, the charging device wire 58 is oriented along a full length off-center of the width of the exemplary charging device shield 50.

As described above, the print process flow direction with respect to the charging device wire 58 defines an upstream direction and a downstream direction. Thus, the locations on the exemplary charging device shield 50 with respect to the charging device wire 58 define upstream and downstream sides of exemplary charging device shield 50.

Figure 6:
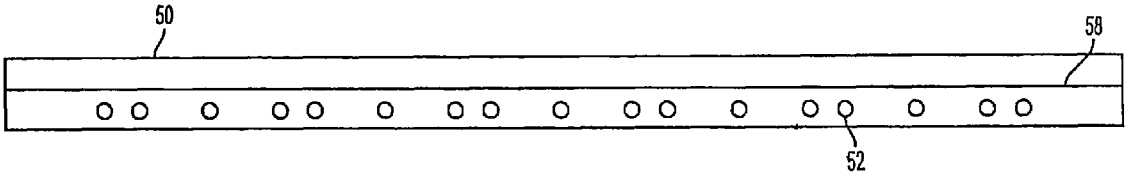
FIG. 6 is a top plan view of a variation of the second embodiment of a charging device shield.
Figure 7:
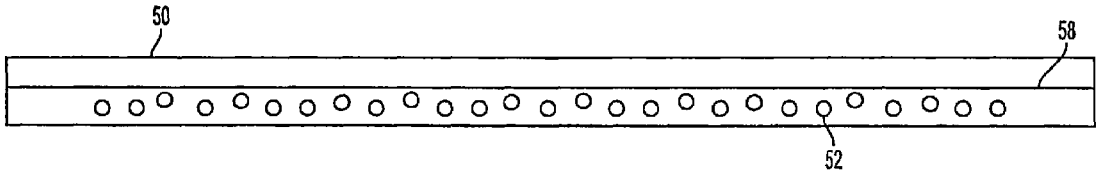
FIG. 7 is a top plan view of a variation of the second embodiment of a charging device shield.
Figure 8:
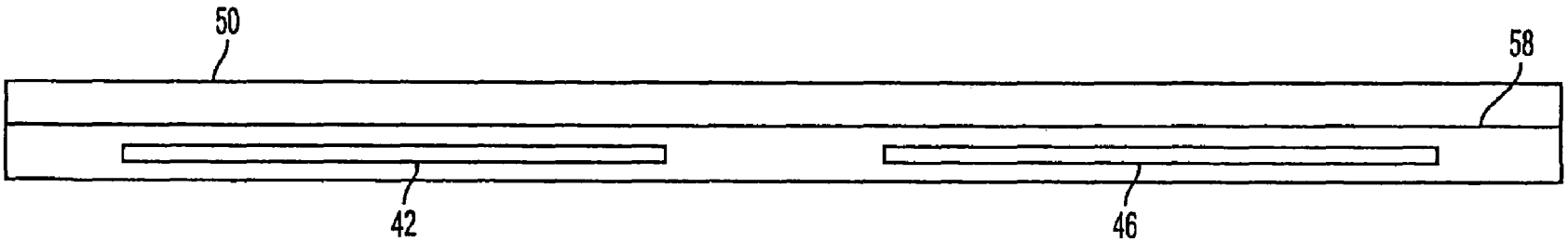
FIG. 8 is a top plan view of a variation of the second embodiment of a charging device shield.
Figure 9:
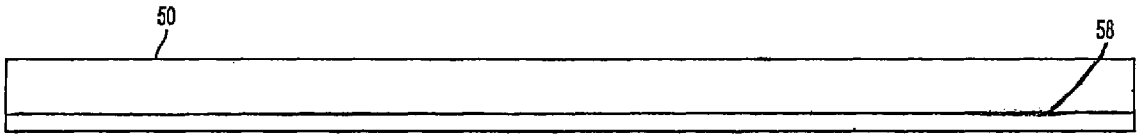
FIG. 9 is a top plan view of a charging device shield and off-center charging device wire.

In the embodiment depicted in FIG. 5, all of the plurality of holes 52 are on the same side of exemplary charging device shield 50 with respect to the charging device wire 58. Thus, depending on the print process flow direction, in the embodiment depicted in FIG. 5, all of the plurality of holes are either on an upstream side of charging device shield 50 or all of the plurality of holes are on a downstream side of charging device shield 50. In various exemplary embodiments, one or more of the plurality of holes 52 are located on an upstream side of the charging device shield 50 and one or more of the plurality of holes 52 are located on a downstream side of the charging device shield 50. FIG. 6 shows unevenly spaced holes 52 only in the downstream side of charging device shield 50. FIG. 7 shows holes 52 configured in a nonlinear manner only in the downstream side of charging device shield 50. FIG. 8 shows rectangular holes only in the downstream side of charging device shield 50. FIG. 9 shows a top plan view of a charging device shield 50 and off-center charging device wire 58. This variation can be applied to all disclosed embodiments of the charging device shield 50.

A comparison of the performance of exemplary charging device shield 50, with respect to the performance of exemplary charging device shield 40 will now be described. Several tests were performed to compare the performance of exemplary charging device shield 50 to the performance of exemplary charging device shield 40 with respect to the rate at which a grid on top of the charging device shield is soiled. The imposition of dirt, toner dust, or other contamination on the grids has a negative effect on the voltage uniformity and the current uniformity of the charging device and thus a negative effect on the print quality of the xerographic printing device incorporating that charging device shield.

In addition to the negative effects of the structure of exemplary charging device shield 40 described above with respect to the removal of the corona effluents, it was also observed in these tests that the rate at which dirt and other soiling or contamination develops on the grids is much greater in a charging device including exemplary charging device shield 40 than in a charging device including exemplary charging device shield 50. Specifically, the development of localized dirt contamination on the grids was observed in the tests of a charging device incorporating exemplary charging device shield 40.

In the tests, the non-uniform deposition of toner contamination on the grid associated with exemplary embodiment of charging device shield 40 had a visibly streaky nature. This translated into a visibly streaky and unwanted deposition of toner on the print pages of subsequent prints from the xerographic printing device incorporating the grid containing the non-uniform streaky deposition of toner contamination on the grids.

In the tests, it was thus determined that the device was a high frequency service item (HFSI). The cleaning interval of the HFSI was determined to be about once every 50,000 prints (50 kp) for the device incorporating exemplary charging device shield 40. Each print corresponds to a printed page.

The tests demonstrated that the negative effects of the discontinuities in the exemplary charging device shield 40 described above were improved upon by the evenly spaced holes depicted in the exemplary charging device shield 50. In the test performed on the exemplary embodiment of the charging device shield 50, the grids were maintained clean up to an interval of approximately 250,000 prints (250 kp). In other words, the improvement in frequency of grid cleaning interval between exemplary charging device shield 40 and exemplary charging device shield 50 is on the order of magnitude of about five-fold.

Based on the foregoing test results, it is believed that the discontinuities in the pattern on the exemplary charging device shield 40 is integrally related to the greater rate at which localized toner builds up on the grid. It is believed that the removal of discontinuities in the structure of the orifices in the charging device shield corresponds to a smoother airflow of the vacuum removal of harmful corona effluents through the vacuum orifices. It is believed that this smoother airflow management system achieved by the removal of discontinuities in the structure of the orifices corresponds to a smoother distribution of toner contamination on the grid, and correspondingly a slower rate at which localized toner contamination builds up on the grid.

It is also believed that the presence of discontinuities on the upstream side of the charging device shield and the presence of discontinuities on the downstream side of the charging device shield both, independently, result in an increased rate of grid contamination in the form of localized dirt contamination, for the reasons described above. However, it is believed that discontinuities on the downstream side of the charging device shield have a greater effect on the rate of increased grid contamination than discontinuities on the upstream side of the charging device shield. Therefore, in the preferred embodiment, the arrangement of orifices is located on the downstream side of the exemplary charging device shield 50.

Based on the test results described above, and for the reasons described above, it is believed that the preferred embodiment of a shield for a charging device in a xerographic printing device is a shield having a plurality of orifices such as holes oriented in a linear manner on a downstream side of the shield, extending nearly the full length of the charging device shield, and being evenly spaced.

By achieving an improved voltage uniformity and current uniformity, and a reduction in the rate of grid soiling, the shield structure described above enables a more efficient operation of the charging devices. This more efficient operation of the charging devices creates a greater latitude in the associated print processes of the xerographic printing device. A higher efficiency in the charging and recharging processes enables more latitude in the exposing, developing and transferring processes of image formation in the xerographic printing device. An improved uniformity in the charge yields a higher accuracy of the subsequent exposing, developing and image transferring processes.

Further, the subsequent exposing, developing and transferring processes also have many inputs. An improved efficiency in the operating of the charging and recharging processes enables a greater tolerance at the margin of the other inputs to the exposing, developing and transferring processes. Further, if all other inputs to the system remain the same, an improvement in the efficiency of the charging and recharging processes will result in an improvement in the overall efficiency with which the system operates.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A charging device for a xerographic printing device, the charging device comprising:

a shield having, relative to a movement direction of a medium to be charged, a downstream shield side and an upstream shield side, a plurality of holes being located only in the downstream shield side.

2. The charging device according to claim 1, wherein the plurality of holes extend nearly a full length of the shield.

3. The charging device according to claim 1, wherein the plurality of holes are evenly spaced.

4. The charging device according to claim 1, wherein the plurality of holes are arranged in a linear fashion.

5. The charging device according to claim 1, where the plurality of holes are unevenly spaced.

6. The charging device according to claim 1, wherein the plurality of holes are arranged in a non-linear fashion.

7. The charging device according to claim 1, wherein the charging device is selected from the list consisting of a corotron, a dicorotron, a scorotron, a discorotron, a pin corotron, and a pin scorotron.

8. The charging device according to claim 1, the charging device further comprising:

a charging wire extending substantially the full length of the charging device.

9. The charging device according to claim 8, wherein the charging wire, relative to the direction of movement of the medium to be charged, is not located in a center of the charging device.

10. The charging device according to claim 8, wherein the charging wire is coated.

11. The charging device according to claim 8, wherein the charging wire is bare.

12. The charging device according to claim 1, wherein the holes are circular.

13. The charging device according to claim 1, wherein the holes are rectangular.

14. A xerographic device comprising:

a charging device according to claim 1.

15. The xerographic device according to claim 14, the xerographic device further comprising:

a vacuum source in operative communication with an interior of the charging device through the holes in the shield to draw airflow through the holes in the shield.

* * * * *